United States Patent [19]

O'Mara

[11] Patent Number: 4,664,152

[45] Date of Patent: May 12, 1987

[54] FLOW CONTROL VALVE WITH REPLACEABLE CARTRIDGE SUBASSEMBLY HAVING MULTI-TUBULAR CONSTRUCTION

[76] Inventor: Michael R. O'Mara, 2531 Blanchard Ave., Moraine, Ohio 45439

[21] Appl. No.: 848,216

[22] Filed: Apr. 4, 1986

[51] Int. Cl.[4] ..... F15B 13/04

[52] U.S. Cl. ..... 137/625.68; 137/454.2; 137/625.69

[58] Field of Search ..... 137/454.2, 625.48, 625.68, 137/625.69

[56] References Cited

U.S. PATENT DOCUMENTS

| | | | |
|---|---|---|---|
| 2,531,511 | 11/1950 | Hill | 137/625.68 |
| 2,648,313 | 8/1953 | Clifton | 137/625.68 |
| 2,910,091 | 10/1959 | Weis | 137/625.48 |
| 3,152,613 | 10/1964 | Shattock | 137/625.48 |
| 3,347,260 | 10/1967 | Lewis et al. | 137/625.48 X |
| 3,388,720 | 6/1968 | Parr | 137/625.69 X |
| 3,418,002 | 12/1968 | Hennells | 137/625.69 X |
| 3,481,364 | 12/1969 | Hodgson et al. | 137/596 |
| 3,565,115 | 2/1971 | Beckett et al. | 137/625.69 |
| 3,596,679 | 8/1971 | Sugden, Jr. | 137/636 |
| 3,763,891 | 10/1973 | Stiltner | 137/625.18 |
| 4,096,880 | 6/1978 | Lemmon et al. | 137/454.2 |
| 4,388,946 | 6/1983 | Richter et al. | 137/596.2 |

FOREIGN PATENT DOCUMENTS

| | | | |
|---|---|---|---|
| 1917261 | 10/1970 | Fed. Rep. of Germany | 137/454.2 |
| 2048525 | 4/1972 | Fed. Rep. of Germany | 137/454.2 |
| 1211697 | 3/1960 | France | 137/625.48 |

*Primary Examiner*—Gerald A. Michalsky

*Attorney, Agent, or Firm*—Ralph L. Marzocco

[57] ABSTRACT

A flow control valve includes an outer housing with a central bore in communication with pressure, return and working ports in the housing, and an inner cartridge subassembly disposed in the housing bore. The subassembly being slidably and sealably receivable within, and removable from, the housing bore is composed of concentrically-nested members arranged for relative movement to define fluid flow paths within the subassembly for connecting the pressure, return and working bores in selected ways. First, the subassembly has a hollow cylinder and a by-pass sleeve press fitted within the cylinder with both adapted to be disposed in a stationary position within the outer housing. Also, a hollow valve spool plugged at its opposite ends to define an interior flow cavity is slidably received within the by-pass sleeve and axially movable to change the fluid flow paths between the housing ports. Finally, the spool includes a self-centering mechanism which is self-contained therein and engaged with the by-pass sleeve and cartridge cylinder such that upon axial movement of the spool in either direction away from a center position the centering mechanism moves therewith and is thereby actuated to return the spool to the center position.

18 Claims, 6 Drawing Figures

FLOW CONTROL VALVE WITH REPLACEABLE CARTRIDGE SUBASSEMBLY HAVING MULTI-TUBULAR CONSTRUCTION

BACKGROUND OF THE INVENTION

1. Field of the Invention

The present invention generally relates to control of working fluid flow and, more particularly, is concerned with a flow control valve construction employing a unique readily replaceable cartridge subassembly.

2. Description of the Prior Art

Flow control valves having a housing or body with a central bore in which a spool is slidable longitudinally between various working and/or neutral positions are well known in the prior art. Representative of the prior art are the flow control valves disclosed in U.S. Pat. Nos. to Hodgson et al (3,481,364), Sugden, Jr. (3,596,679), Stiltner (3,763,891) and Richter et al (4,388,946). One typical conventional valve is the four-way valve exemplified by Stiltner wherein the valve body has a pair of pressure and return ports and a pair of working ports. Also, the valve slide or spool is spring loaded to a neutral center position and actuatable to right or left of center working positions. In the neutral center position, fluid from a source is conducted via the pressure port to the return port, bypassing the pair of working ports. In the right of center working position, fluid is conducted via the pressure port to one of the working ports and then returned via the other working port to the return port. On the other hand, in the left of center working position, just the opposite occurs, namely, fluid is conducted via the pressure port to the other working port and then returned via the one working port to the return port.

One common shortcoming of conventional flow control valves, as also exemplified by Stiltner, is that their various constructions do not facilitate quick and easy repair and maintenance in the field. Typically, in order for repair or replacement of their components to be carried out, they have to be removed from service. For instance, such procedure would be necessary in the case of the Stiltner valve in view of the multiplicity of parts which must be removed and accounted for in disassembling the valve.

Consequently, a need exists for improvements in flow control valve construction which will eliminate this shortcoming without, at the same time, offsetting the benefits to be derived therefrom by increasing overall cost of the valve.

SUMMARY OF THE INVENTION

The present invention provides a unique flow control valve construction designed to satisfy the aforementioned needs. The valve construction of the present invention employs a readily replaceable cartridge subassembly built of multiple concentrically-nested tubes which facilitates maintenance of the valve without first requiring its removal from field service and allows fabrication of the valve in minimum time, utilizing only standard materials and conventional techniques. Specifically, the cartridge subassembly can be removed merely by taking out a locking screw and pushing or pulling the subassembly out of the valve housing. A new or repaired cartridge subassembly can then be installed with the entire operation taking only a few minutes and without requiring the removal of the valve housing or the attached fluid transmission lines. Depending on the pressure requirements of the particular application, the valve could be constructed of a light, easily-machined metal or plastic. With its unique multi-tubular design, the valve cartridge subassembly can be constructed from tubes specified with dimensions close to the finished size thus reducing machining cost and time to a minimum.

Accordingly, the present invention is directed to a flow control valve, comprising: (a) an outer valve housing having a central bore and fluid flow ports defined through the housing and in communication with the bore; (b) an inner cartridge subassembly having first and second members being arranged for relative movement to define a plurality of fluid flow paths within the subassembly, the subassembly as a unit being slidably and sealably receivable in the bore of the outer housing; and (c) means for attaching the inner subassembly to the outer housing when received therein such that the plurality of flow paths defined in the subassembly are connectible to selected ones of the fluid flow ports of the housing upon relative movement of the first and second members, the attaching means being releasable for detaching the subassembly from the housing to permit its removal as a unit from the housing.

More particularly, the first member of the cartridge subassembly includes a hollow cartridge cylinder adapted to be stationarily positioned relative to the outer housing when the subassembly is attached to the outer housing by the attaching means. Also, the cartridge cylinder has a series of annular circumferential axially-spaced passage grooves defined thereabout and a series of circumferentially-spaced passage openings defined therethrough within each of the grooves. The grooves and openings therein are aligned respectively with the fluid flow ports of the outer housing when the subassembly is received within the housing. Also, the first member includes a hollow by-pass sleeve fitted within the cartridge cylinder so as to adapt the sleeve to be stationarily positioned with the cartridge cylinder relative to the outer housing. The by-pass sleeve has a series of circumferentially-spaced passage holes defined therethrough and aligned in communication with the passage openings of the cartridge cylinder and a plurality of axially and circumferentially-spaced passage slots defined therethrough.

Additionally, the second member of the cartridge subassembly includes a valve spool having a hollow cavity therein and being slidably received within the by-pass sleeve. The spool has annular circumferential lands and recesses defined thereabout in alternating relationship which align with the respective fluid flow ports of the outer housing when the spool is in a center position within the by-pass sleeve. A flow orifice is defined through the spool in each recess located axially outwardly of each land and in communication with the spool cavity. The passage slots in the by-pass sleeve have a length greater than the width of the lands of the spool and are aligned with the spool lands when the spool is in the centered position so as to allow fluid to by-pass the lands and flow between the recesses thereof.

Also, the second member of the cartridge subassembly includes a self-centering mechanism contained within the hollow valve spool and engaged with the by-pass sleeve and cartridge cylinder such that upon axial movement of the spool in either direction away from the center position the self-centering mechanism moves therewith and is thereby actuated to return the spool to the position. The valve spool has a pair of axially extending slots defined in opposite sides thereof adjacent the self-centering mechanism contained therein such that a pin of the self-centering mechanism extends transversely of and through the slots of the spool and engages the by-pass sleeve and cartridge cylinder at opposite ends of the pin. Further, the self-centering mechanism also includes a pair of spring devices disposed on opposite sides of the pin such that one of the spring devices is compressed by the pin upon movement of the spool in one direction and the other of said spring devices is compressed by the pin upon movement of the spool in an opposite direction.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
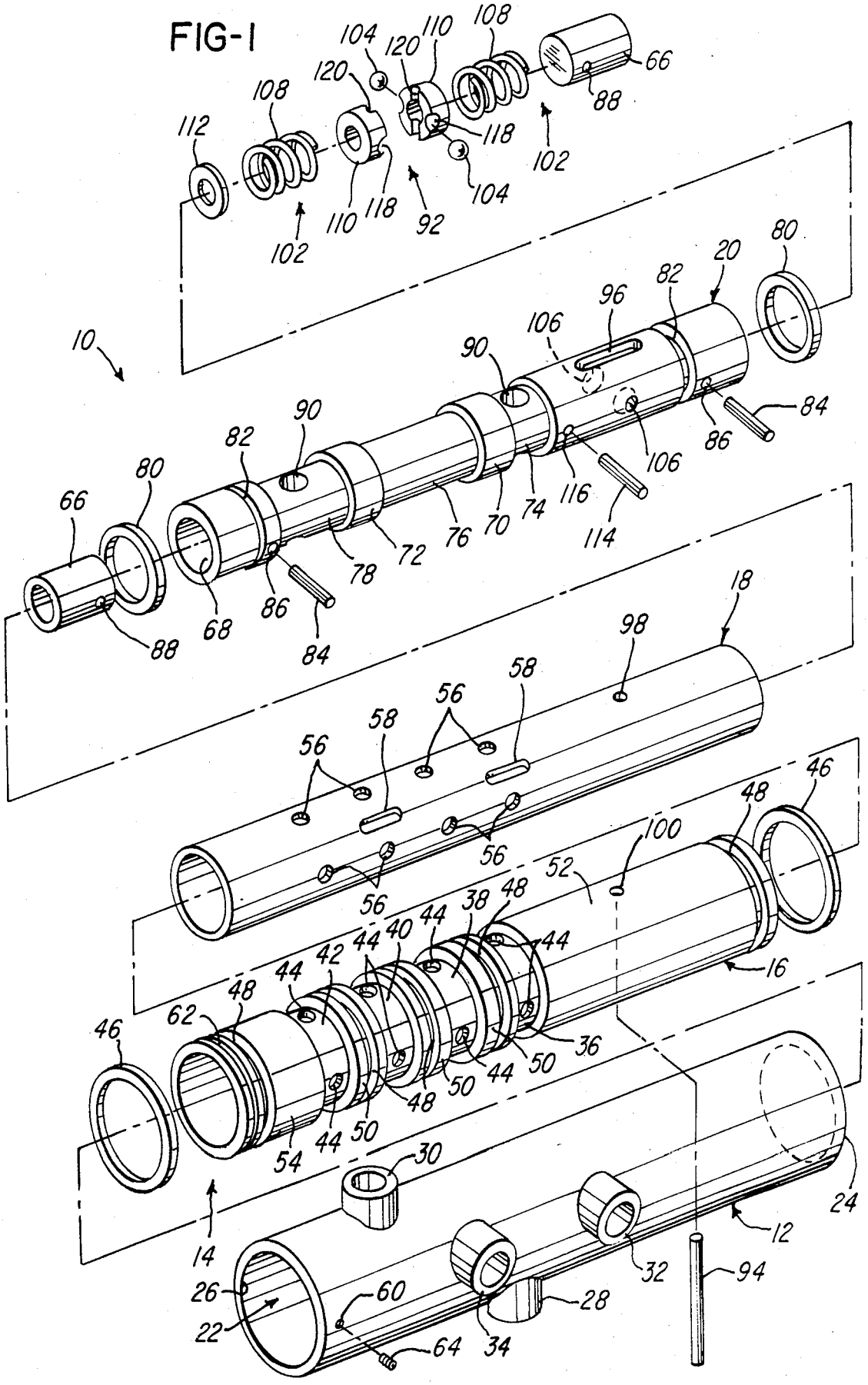
FIG. 1 is a perspective exploded view of the components of the flow control valve of the present invention.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Figures 2, 3, 4:
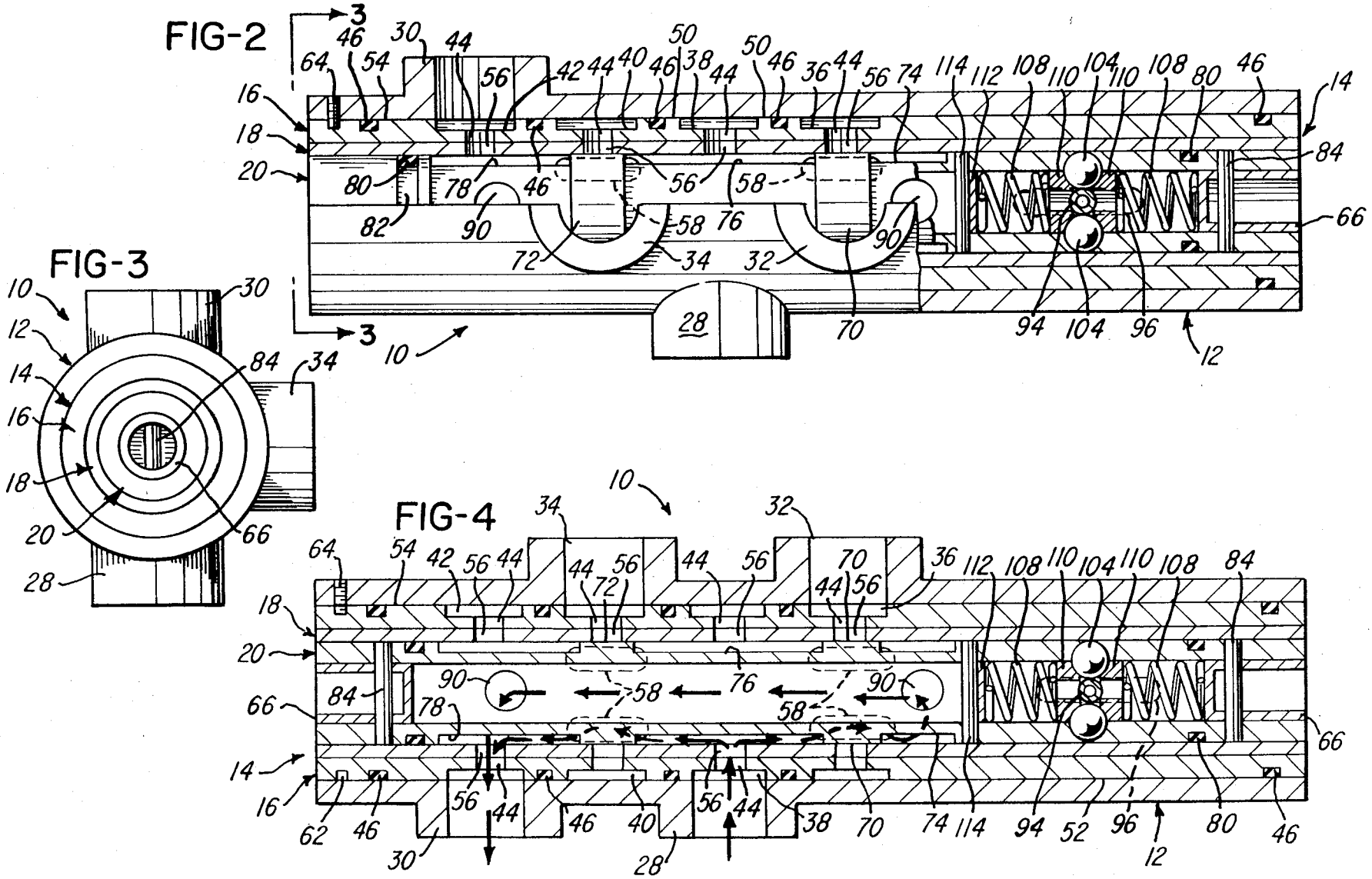
FIG. 2 is a plan view of the control valve of FIG. 1 with the components assembled and portions thereof broken away and sectioned.
FIG. 3 is an end view of the control valve as seen along line 3—3 of FIG. 2.
FIG. 4 is a diagrammatic view of the control valve of FIG. 2 with its spool in a neutral center position.

Referring now to the drawings, and particularly to FIGS. 1 to 3, there is illustrated a flow control valve, generally designated by the numeral 10 and constituting the preferred embodiment of the present invention, being shown disassembled in FIG. 1 and assembled in FIG. 2. In its basic components, the control valve 10 includes an outer cylindrical valve housing 12 and a removable inner cylindrical cartridge subassembly, generally designated 14, being composed of a cartridge cylinder 16, a by-pass sleeve 18 and a hollow valve spool 20. The outer valve housing 12 has a central bore 22 with open opposite ends 24, 26 and fluid flow pressure, return and right and left working ports 28, 30, 32, 34 defined through and located axially along the housing 12 and in communication with the bore 22. As seen in FIG. 3, when assembled together, the housing 12, cylinder 16, sleeve 18 and spool 20 form a concentrically-nested multitubular arrangement.

The cartridge cylinder 16 has a succession of four annular circumferential axially-spaced passage grooves 36, 38, 40, 42 machined or otherwise formed thereabout in its left half as seen in FIGS. 1 and 2 and a series of four passage openings 44 circumferentially-spaced ninety degrees from one another being defined through the cylinder 16 within each of its grooves 36–42. In addition, the cylinder 16 has annular sealing rings 46 disposed respectively in circumferential recesses 48 machined adjacent opposite ends thereof and within each of a series of three lands 50 which together with the other surface portions 52, 54 of the cylinder define the passage grooves 36–42 therebetween.

The outside diameter of the by-pass sleeve 18 is just slightly less than the inside diameter of the cartridge cylinder 16 so that when the sleeve is pressed into the cylinder 16 a tight fitting relationship is formed between the two in which they essentially become one member. The cylindrical hollow by-pass sleeve 18 has passage holes 56 defined through it and aligned in communication with the passage openings 44 of the cartridge cylinder 16. Preferably, the cylinder openings 44 and sleeve holes 56 are formed by drilling through both the cylinder 16 and sleeve 18 after the sleeve has been press fitted into its concentrically-nested position within the cylinder. However, before the sleeve 18 is fitted into the cylinder 16, two axially-spaced rows of passage slots 58 with four in each row circumferentially-spaced ninety degrees from one another are machined through the left half of the sleeve, as seen in FIGS. 1 and 2. The rows of slots 58 in the sleeve 18 are spaced apart through the same distance as the inner right and the left passage grooves 38, 42 of the cylinder 16 so that when the sleeve 18 is then fitted into the cylinder the two rows of slots 58 are aligned with two passage grooves 38, 42. Then, the passage openings 44 and holes 56 are drilled into the cylinder 16 and sleeve 18 so that the ones in two rows thereof associated with passage grooves 38, 42 will be located alternately between the slots 58.

The cartridge cylinder 16, and the by-pass sleeve 18 when press fitted therein so that the two in effect act as a single member, are adapted to be slidably and sealably inserted into the bore 22 of the outer valve housing 12 and held in a stationary position therein by any suitable attaching means. In the stationary position of the inner subassembly 14 as seen in FIG. 2, the passage grooves 36–42, openings 44 and holes 56 of the cylinder 16 and sleeve 18 are aligned respectively with the fluid flow right working, pressure, left working and return ports 32, 28, 34, 30 of outer housing 12. Thus, the attaching means connects the inner cartridge subassembly 14 to the outer housing 12 and the subassembly extends from one of the open opposite ends 24, 26 of the housing to the other, as seen in FIG. 2. The attaching means is also releasable for detaching the subassembly 14 from the housing 12 to permit its removal as a unit therefrom for repair or replacement.

Preferably, an attaching means, such as shown in FIGS. 1 and 2, is used which will make the removal and replacement of the cartridge assembly 14 as quick and easy as possible. For instance, the attaching means might take the form of a threaded hole 60 in the left surface portion of the outer housing 12, a circumferential groove in the cartridge cylinder 16 being aligned with the hole 60 when the inner cartridge subassembly 14 is received within the outer housing 12, and a threaded fastener 64, such as a set screw, threadable through the hole 60 into engagement with the groove 62 for fixedly attaching the subassembly 14 to the outer housing.

Thus, the cartridge cylinder 16 and by-pass sleeve 18 when fitted together form one of two members of the inner cartridge subassembly 14 which are arranged for relative movement to define a plurality of fluid flow paths within the subassembly which are connectible to selected ones of the fluid flow ports 28–34 of the housing, as will be explained later. The other of the two members of the inner cartridge subassembly 14 is the hollow cylindrical valve spool 20.

The valve spool 20 is closed at its opposite ends by plugs 66 to define an interior flow cavity 68 therein. The valve spool 20 is slidably received within the by-pass sleeve 18 and has two annular circumferential lands 70, 72 and three recesses 74, 76, 78 defined thereabout in alternating relationship axially along a generally left half of the spool. The two lands 70, 72 and center and left two recesses 76, 78 are aligned with respective passage grooves 36–42 of the cylinder 16 and fluid flow ports 28–34 of the outer housing 12 when the spool 20 is in a center position within the by-pass sleeve 18, as seen in FIG. 2. Also, the spool 20 is fitted with a pair of sealing rings 80 in circumferential recesses 82 formed at locations inwardly from the opposite ends of the spool. Pins 84 are inserted into holes 86 defined through the spool 20 adjacent the recesses 82 and received in holes 88 in the plugs 66 for securing the plugs in the spool. Finally, the spool 20 has a flow orifice 90 defined therethrough in each of the right and left recesses 74, 78 located axially outwardly of the respective lands 70, 72 and in communication with the spool interior cavity 68. The passage slots 58 in the by-pass sleeve 18 have a length greater than the width of the lands 70, 72 of the spool 20 and are aligned with lands when the spool is in its center position so as to allow fluid to by-pass the lands and flow between the recesses 74 - 78 thereof and therefrom through the orifices 90 and into the spool cavity 68.

The valve spool 20 is normally disposed in its center position of FIG. 2 by a self-centering mechanism, generally designated 92, which is self-contained within the interior cavity 68 in the right half of the hollow valve spool 20. The self-centering mechanism 92 includes a central pin 94 which extends transversely of and through a pair of axially extending slots 96 formed in opposite sides of the spool 20 adjacent the self-centering mechanism 92. Opposite ends of the pin 94 are engaged in holes 98, 100 defined respectively in the sleeve 18 and cylinder 16.

Also, the self-centering mechanism 92 includes a pair of spring devices, generally indicated 102, and a pair of stop balls 104. The stop balls 104 are seated in oppositely-aligned concave-shaped holes 106 formed in the spool 20 so as to be positioned on opposite sides of the central engaging pin 94 when the spool is centered, as seen in FIG. 2. Each spring device 102 is composed of a centering return spring 108 and an engaging block 110. The right return spring 108 is captured between the right plug 66 and the right engaging block 110 when the latter is positioned against the right side of the stop balls 104. The left return spring 108 is captured between the left engaging block 110 when the latter is positioned against the left side of the stop balls 104 and a washer 112 abutting a locating pin 114 inserted through holes 116 in the spool adjacent the right recess 74 thereof. Each of the engaging blocks 110 have a pair of depressions 118 shaped to mate or seat with the respective sides of the stop balls 104 and a generally vertically-extending recess 120 shaped to receive the central engaging pin 94. When the spool 20 is moved in either axial direction (right or left of center) away from the center position of FIG. 2, the return spring 108 of the one of spring devices 102 on the opposite side of the stationary engaging pin 94 from the direction of movement is compressed by the pin via the respective one of the engaging blocks 110 on that side and will return the spool 20 to the center position once the force moving the spool is released.

Therefore, centering of the spool 20 is accomplished by the opposing action of the two centering return springs 108 forcing the engaging blocks 110 against the engaging pin 94 to rest positions against the respective stop balls 104. Although not shown, the plugs 66 at opposite ends of the spool 20 would be machined to accept attachment of operating levers on either end to move the valve spool 20. Also, it will be readily seen that the mechanism 92, by being enclosed within the inner cartridge subassembly 14 as described above, is not exposed to corrosion or contamination which over time would cause sticking and unreliable operation.

From the above description, it should be understood that since the inner subassembly 14 can be removed easily from the housing 12, any welding, cutting or drilling operation can be performed on the housing without fear of damage to the subassembly 14. This makes it convenient to modify the housing in a new or retrofit project. Also, in equipment using multiple valve arrangements, more than one valve can be operated at a time. Only simple machining cuts and drilling operations are used to construct the components of the valve. Parts inventory can be reduced by the need to stock only the inner cartridge subassembly which will fit all housings.

OPERATION

Figure 5:
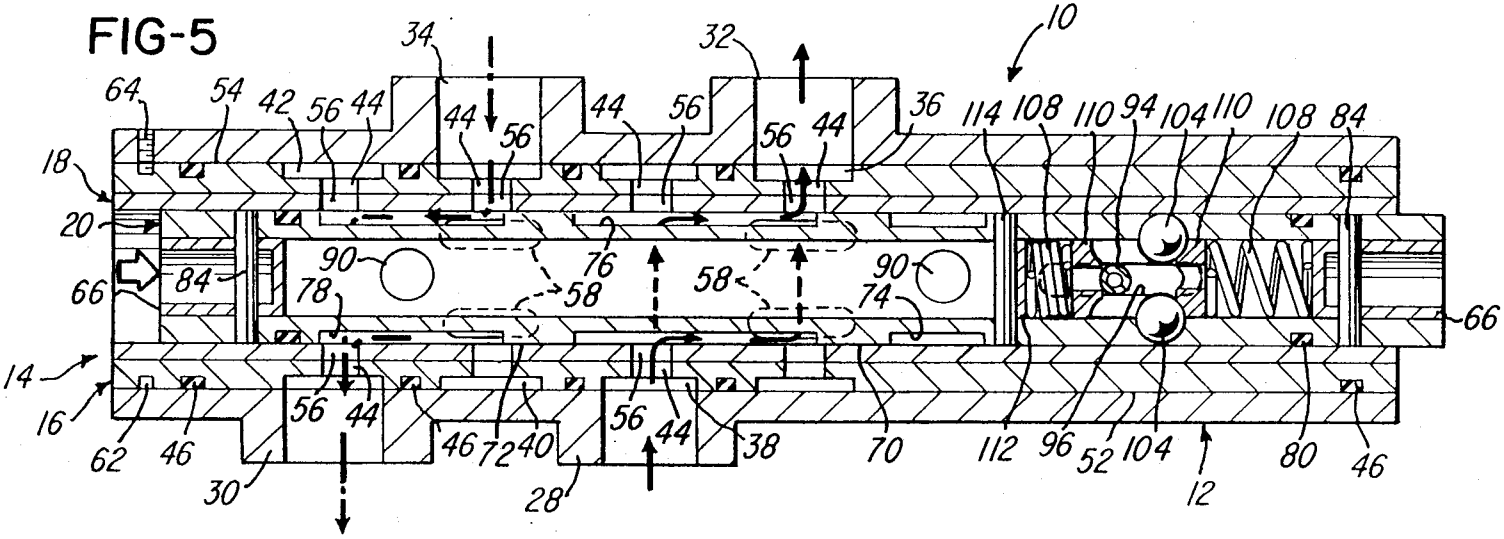
FIG. 5 is a diagrammatic view of the control valve of FIG. 2 with its spool in a right of center position.
Figure 6:
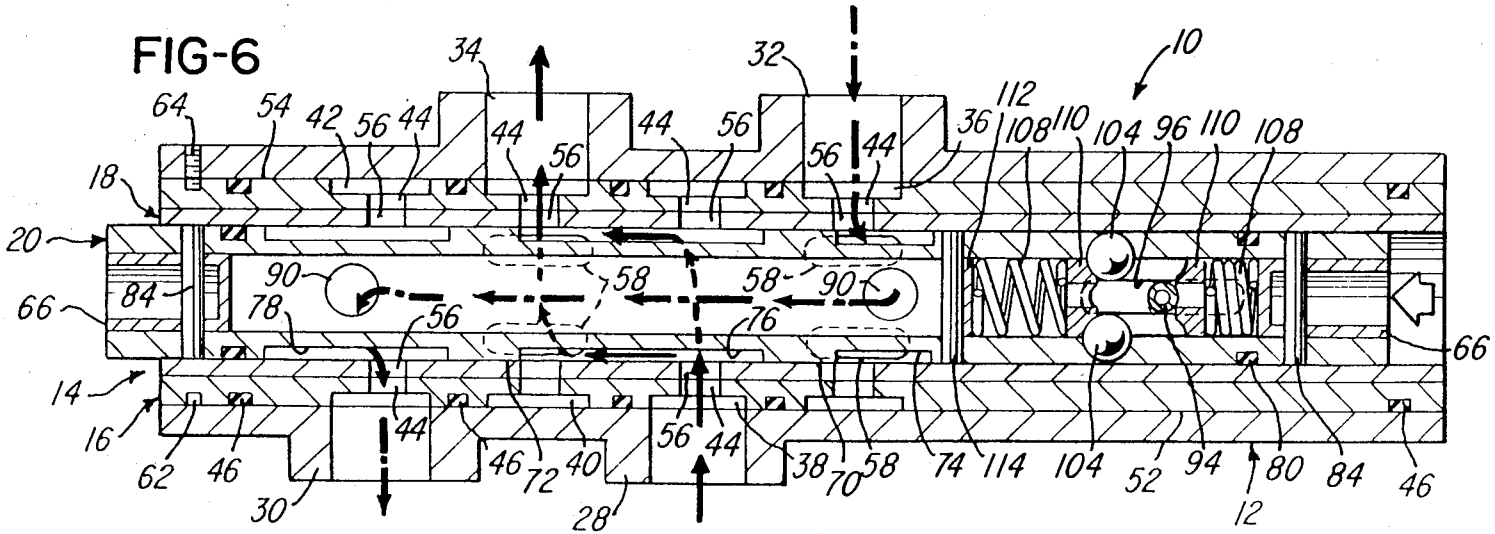
FIG. 6 is a diagrammatic view of the control valve of FIG. 2 with its spool in a left of center position.

FIGS. 4 to 6 illustrate respectively the neutral, working right and working left positions of the valve spool 20 and corresponding center, right of center and left of center positions of the self-centering mechanism 92 being self-contained in the inner cartridge subassembly 14 of the valve 10.

Referring to FIG. 4, since no motive force is being applied to the valve spool 20, the return springs 108 of the self-centering mechanism 92 are both extended and holding the spool 20 in its center position by imposing opposite and equal forces on the engaging pin 94 through their respective engaging blocks 110. In the center position, the opposite ends of the spool 20 are flush with the opposite ends of the outer housing 12 and the cylinder 16 and sleeve 18 of the inner subassembly 14. Thus, there are not interior surfaces of the sliding parts which are exposed when the valve 10 is in neutral position.

In this neutral position of the spool 20, the valve 10 does no work and fluid flow is by-passed through the valve from the pressure port 28 to the return port 30 of the housing 12, by-passing the working ports 32, 34. In particular, fluid flow enters the pressure port 28 and passes around the inner right passage groove 38 in the cylinder 16 and therefrom through the aligned cylinder passage openings 44 and sleeve passage holes 56. From the sleeve holes 56, fluid flows in the center recess 76 of the spool 20 and by-passes, via passage slots 58 in the sleeve 18, the two lands 70, 72 blocking the working ports 32, 34. On the one hand, the flow by-passing the left land 72 flows into the left recess 78 of the spool 20 outwardly therefrom through the passage holes 56 and openings 44 of the sleeve 18 and cylinder 16, around the left cylinder passage groove 42 and out the return port 30. On the other hand, the flow by-passing the right land 70 flows into the right recess 74 of the spool 20 and therefrom into its interior cavity 68 via the right orifice 90, then leftward through the cavity and out the left orifice 90 to the left recess 78, where the flow follows the same route out to the return port 30.

Thus, when the valve spool 20 is in its center position, both working ports 32, 34 are blocked by the spool lands 70, 72 and by-passed by the fluid flow. Consequently, fluid flow is not allowed to enter nor leave through the working ports.

Referring to FIG. 5, the valve spool 20 has been moved to its right of center position which causes compression of the left return spring 108 of the self-centering mechanism 92 between the washer 112 which moves with the spool and the left engaging block 110 which is restrained from moving with the spool due to its engagement with the stationary central pin 94. The right return spring 108 remains undisturbed with its right engaging block 110 seated against the stop balls 104. When the motive force is removed from the valve spool 20, the compressed left spring 108 will cause return movement of the spool 20 toward the left to its center position of FIG. 4.

In the right of center position, the fluid flow through the passage slots 58 to by-pass the spool lands 70, 72 is blocked by the lands being positioned at the right ends of the slots 58. Thus, direct flow of fluid from the pressure port 28 to the return port 30 so as to by-pass the working ports 32, 34 is prevented. Instead, fluid pressure builds up in the center recess 76 of the spool 20 between the lands 70, 72. The pressure port 28 and the right working port 32 are directly connected by the central recess 76 of the spool 20 which is axially positioned in communication with the right and inner right passage grooves 36, 38 of the cartridge cylinder 16 and thereby the respective passage openings 44 and holes 56 through the cylinder 16 and sleeve 18 aligned with the grooves 36, 38. Consequently, fluid flows under pressure from the pressure port 28 to the right working port 32 along the solid line path in FIG. 5. Similarly, the return port 30 and the left working port 34 are directly connected by the left recess 78 of the spool 20 which is axially positioned in communication with the left and inner left passage grooves 40, 42 of the cylinder 16 and thereby the respective passage openings 44 and holes 56 through the cylinder 16 and sleeve 18 aligned with the grooves 40, 42. Consequently, returning fluid flows from the left working port 34 to the return port 30 along the dashed line path in FIG. 5.

Referring to FIG. 6, the valve spool 20 has been moved to its left of center position which causes compression of the right return spring 108 of the self-centering machanism 92 between the right plug 66 which moves with the spool and the right engaging block 110 which is restrained from moving with the spool due to its engagement with the stationary central pin 94. The left return spring 108 remains undisturbed with its left engaging block 110 seated against the stop balls 104. When the motive force is removed from the valve spool 20, the compressed right spring 108 will cause return movement of the spool 20 toward the right to its center position of FIG. 4.

In the left of center position, fluid flow out and in the working ports 32, 34 is now reversed. Specifically, the fluid flow through the passage slots 58 to by-pass the spool lands 70, 72 is again blocked by the lands, but this time by the lands being positioned at the left ends of the slots 58. Thus, direct flow of fluid from the pressure port 28 to the return port 30 so as to by-pass the working ports 32, 34 is again prevented. Instead, fluid pressure builds up in the center recess 76 of the spool 20 between the lands 70, 72. However, now the pressure port 28 and the left working port 34 are directly connected by the central recess 76 of the spool 20 which is axially positioned in communication with the inner right and inner left passage grooves 38, 40 of the cartridge cylinder 16 and thereby the respective passage openings 44 and holes 56 through the cylinder 16 and sleeve 18 aligned with the grooves, 38, 40. Consequently, fluid flows under pressure from the pressure port 28 to the left working port 34 along the solid line path in FIG. 6. The return port 30 and the right working port 32 are now connected by the interior cavity 68 of the spool 20 which communicates with the right and left recesses 74, 78 of the spool via the flow orifices 90. The right and left recesses 74, 78 are, in turn, connected in communication with the right and left passage grooves 36, 42 of the cylinder via the respective passage openings 44 and holes 56 through the cylinder 16 and sleeve 18 aligned with the grooves 36, 42. Consequently, returning fluid flows from the right working port 32 to the return port 30 along the dashed line path in FIG. 6.

It is thought that the flow control valve of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A flow control valve, comprising:

(a) an outer valve housing having a central bore and fluid flow ports defined through said housing and in communication with said bore;

(b) an inner cartridge subassembly having first and second members being arranged for relative movement to define a plurality of fluid flow paths within said subassembly, said subassembly as a unit being slidably and sealably receivable in said bore of said outer housing; and (c) means for attaching said inner subassembly to said outer housing when received therein such that said plurality of flow paths defined in said subassembly are connectible to selected ones of said fluid flow ports of said housing upon relative movement of said first and second members, said attaching means being releasable for detaching said subassembly from said housing to permit its removal as a unit from said housing;

(d) said first member of said cartridge subassembly including a hollow cartridge cylinder adapted to be stationarily positioned relative to said outer housing when said subassembly is attached to said outer housing by said attaching means and a hollow by-pass sleeve fitted within said cartridge cylinder so as to adapt said sleeve to be stationarily positioned with said cartridge cylinder relative to said outer housing;

(e) said second member of said cartridge subassembly including a valve spool having a hollow cavity and being slidably received within said by-pass sleeve and a self-centering mechanism contained within said valve spool and engaged with said by-pass sleeve and cartridge cyclinder such that upon axial movement of said spool in either direction away from a center position within said by-pass sleeve said self-centering mechanism moves therewith and is thereby actuated to return said spool to said center position.

2. The flow control valve as recited in claim 1, wherein said cartridge cylinder has a series of annular circumferential axially-spaced passage grooves defined thereabout and a series of circumferentially-spaced passage openings defined therethrough within each of said grooves, said grooves and openings therein being aligned respectively with said fluid flow ports of said outer housing when said subassembly is received within said housing.

3. The flow control valve as recited in claim 2, wherein said by-pass sleeve has a series of circumferentially-spaced passage holes defined therethrough and aligned in communication with said passage openings of said cartridge cylinder and a plurality of axially and circumferentially-spaced passage slots defined therethrough.

4. The flow control valve as recited in claim 3, wherein said spool has annular circumferential lands and recesses defined thereabout in alternating relationship which align with said respective fluid flow ports of said outer housing when said spool is in said center position within said by-pass sleeve.

5. The flow control valve as recited in claim 4, wherein said spool also has a flow orifice defined therethrough in each recess located axially outwardly of each land and in communication with said spool cavity.

6. The flow control valve as recited in claim 4, wherein said passage slots in said by-pass sleeve have a length greater than the width of said lands of said spool and are aligned with said spool lands when said spool is in said centered position so as to allow fluid to by-pass said lands and flow between said recesses thereof.

7. The flow control valve as recited in claim 1, wherein:

said valve spool has a pair of axially extending slots defined in opposite sides thereof adjacent said centering mechanism contained therein; and said self-centering mechanism includes a pin extending transversely of and through said slots of said spool and engaging said by-pass sleeve and cartridge cylinder at opposite ends of said pin and a pair of spring devices disposed on opposite sides of said pin such that one of said spring devices is compressed by said pin upon movement of said spool in one direction and the other of said spring devices is compressed by said pin upon movement of said spool in an opposite direction.

8. A flow control valve, comprising:

(a) an outer cylindrical valve housing having a central bore with open opposite ends and fluid flow ports defined through said housing and in communication with said bore;

(b) an inner cylindrical cartridge subassembly having first and second tubular concentrically-nested members being arranged for relative movement to define a plurality of fluid flow paths within said subassembly, said cartridge subassembly as a unit being slidably and sealably receivable in said bore of said outer housing through one of said open opposite ends thereof; and (c) means for attaching said inner subassembly to said outer housing when received therein such that said subassembly extends from one of said open opposite ends of said housing to the other and said plurality of flow paths are connectible to selected ones of said fluid flow ports of said housing upon relative movement of said first and second members, said attaching means being releasable for detaching said subassembly from said housing to permit its removal as a unit from said housing;

(d) said first member of said cartridge subassembly including a hollow cartridge cylinder adpated to be stationarily positioned relative to said outer housing when said subassembly is attached to said outer housing by said attaching means and a cylindrical hollow-by-pass sleeve concentrically-nested and press-fitted within said cartirdge cylinder so as to adapt said sleeve to be stationarily positioned with said cartridge cylinder relative to said outer housing;

(e) said second member of said cartridge subassembly including a hollow cylindrical valve spool being plugged at its opposite ends to define an interior flow cavity therein and slidably received within said by-pass sleeve and a self-centering mechanism self-contained within said hollow valve spool and engaged with said by-pass sleeve and cartridge cylinder such that upon axial movement of said spool in either direction away from a center position within said by-pass sleeve said self-centering mechanism moves therewith and is thereby actuated to return said spool to said center position.

9. The flow control valve as recited in claim 8, wherein said fluid flow ports include a pair of pressure and return ports and a pair of working ports, said ports being axially displaced along said housing.

10. The flow control valve as recited in claim 9, wherein said cartridge cylinder has four annular circumferential axially-spaced passage grooves defined thereabout and at least one circumferentially-spaced passage opening defined therethrough within each of said grooves, said grooves and openings therein being aligned respectively with said pressure, return and working ports of said outer housing when said subassembly is received within said housing.

11. The flow control valve as recited in claim 10, wherein said by-pass sleeve has passage holes defined therethrough and aligned in communication with said passage openings of said cartridge cylinder and a plurality of axially and circumferentially-spaced passage slots defined therethrough.

12. The flow control valve as recited in claim 11, wherein said valve spool has two annular circumferential lands and three recesses defined thereabout in alternating relationship axially along said spool, said two lands and two of said recesses in alternating relationship therewith being aligned with said respective pressure, return and working ports of said outer housing when said spool is in said center position within said by-pass sleeve.

13. The flow control valve as recited in claim 12, wherein said spool also has a flow orifice defined therethrough in each recess located axially outwardly of each land and in communication with said spool cavity.

14. The flow control valve as recited in claim 13, wherein said passage slots in said by-pass sleeve have a length greater than the width of said lands of said spool and are aligned with said spool lands when said spool is in said centered position so as to allow fluid to by-pass said lands and flow between said recesses thereof and therefrom through said orifices and into said spool cavity.

15. The flow control valve as recited in claim 8, wherein said attaching means includes:

means defining a threaded hole in said outer housing:

means defining a circumferential groove in said cartridge cylinder being aligned with said hole when said cartridge subassembly is received within said outer housing; and a threaded fastener threadable through said hole into engagement with said groove for fixedly attaching said subassembly to said outer housing.

16. The flow control valve as recited in claim 8, wherein:

said valve spool has a pair of axially extending slots defined in opposite sides thereof adjacent said centering mechanism contained therein; and said self-centering mechanism includes a pin extending transversely of and through said slots of said spool and engaging said by-pass sleeve and cartridge cylinder at opposite ends of said pin and a pair of spring devices disposed on opposite sides of said pin such that one of said spring devices is compressed by said pin upon movement of said spool in an opposite direction.

17. A flow control valve, comprising:

(a) an outer valve housing having a central bore and fluid flow ports defined through said housing and in communication with said bore;

(b) an inner cartridge subassembly having first and second members being arranged for relative movement to define a plurality of fluid flow paths within said subassembly, said subassembly as a unit being slidably and sealably receivable in said bore of said outer housing; and (c) means for attaching said inner subassembly to said outer housing when received therein such that said plurality of flow paths defined in said subassembly are connectible to selected ones of said fluid flow ports of said housing upon relative movement of said first and second members, said attaching means being releasable for detaching said subassembly from said housing to permit its removal as a unit for said housing;

(d) said first member of said cartridge subassembly including a hollow cartridge cylinder adapted to be stationarily positioned relative to said outer housing when said subassembly is attached to said outer housing by said attaching means, said cartridge cylinder having a series of annular circumferential axially-spaced passage grooves defined thereabout and a series of circumferentially-spaced passage openings defined therethrough within each of said grooves, said grooves and openings therein being aligned respectively with said fluid flow ports of said outer housing when said subassembly is received within said housing;

(e) said first member of said cartridge subassembly further including a hollow by-pass sleeve fitted within said cartridge cylinder so as to adapt said sleeve to be stationarily positioned with said cartridge cylinder relative to said outer housing, said by-pass sleeve having a series of circumferentially-spaced passage holes defined therethrough and aligned in communication with said passage openings of said cartridge cylinder and a plurality of axially and circumferentially-spaced passages slots defined therethrough;

(f) said second member of said cartridge subassembly including a valve spool having a hollow cavity and being slidably received within said by-pass sleeve, said spool having annular circumferential lands and recesses defined thereabout in alternating relationship which align with said respective fluid flow ports of said outer housing when said spool is in a center position within said by-pass sleeve;

(g) said second member of said cartridge subassembly further including a self-centering mechanism contained within said valve spool and engaged with said by-pass sleeve and cartridge cylinder such that upon axial movement of said spool in either direction away from said center position said self-centering mechanism moves therewith and is thereby actuated to return said spool to said center position.

18. A flow control valve, comprising:

(a) an outer cylindrical valve housing having a central bore with open opposite ends and fluid flow ports defined through said housing and in communication with said bore, said fluid flow ports including a pair of pressure and return ports and a pair of working ports, said ports being axially displaced along said housing;

(b) an inner cylindrical cartridge subassembly having first and second tubular concentrically-nested members being arranged for relative movement to define a plurality of fluid flow paths within said subassembly, said cartridge subassembly as a unit being slidably and sealably receivable in said bore of said outer housing through one of said open opposite ends thereof; and (c) means for attaching said inner subassembly to said outer housing when received therein such that said subassembly extends from one of said open opposite ends of said housing to the other and said plurality of flow paths are connectible to slected ones of said fluid flow ports of said housing upon relative movement of said first and second members, said attaching means being releasable for detaching said subassembly from said housing to permit its removal as a unit from said housing;

(d) said first member of said cartridge subassembly including a hollow cartridge cylinder adapted to be stationarily positioned relative to said outer housing when said subassembly is attached to said outer housing by said attaching means, said cartridge cylinder having four annular circumferential axially-spaced passage grooves defined thereabout and at least one circumferentially-spaced passage opening defined therethrough within each of said grooves, said grooves and openings therein being aligned respectively with said pressure, return and working ports of said outer housing when said subassembly is received with said housing;

(e) said first member of said cartridge subassembly further including a cylindrical hollow by-pass sleeve concentrically-nested and press-fitted within said cartridge cylinder so as to adapt said sleeve to be stationarily positioned with said cartridge cylinder relative to said outer housing, said by-pass sleeve having passage holes defined therethrough and aligned in communication with said passage openings of said cartridge cylinder and a plurality of axially and circumferentially-spaced passage slots defined therethrough;

(f) said second member of said cartridge subassembly including a hollow cylindrical valve spool being plugged at its opposite ends to define an interior flow cavity therein, said valve spool being slidably received within said by-pass sleeve and having two annular circumferential lands and three recesses defined thereabout in alternating relationship axially along said spool, said two lands and two of said recesses in alternating relationship therewith being aligned with said respective pressure, return and working ports of said outer housing when said spool is in a center position within said by-pass sleeve;

(g) said second member of said cartridge subassembly further including a self-centering mechanism self-contained within said hollow valve spool and engaged with said by-pass sleeve and cartridge cylinder such that upon axial movement of said spool in either direction away from said center position said self-centering mechanism moves therewith and is thereby actuated to return said spool to said center position.

* * * * *